US012037218B2

(12) United States Patent
Ando et al.

(10) Patent No.: US 12,037,218 B2
(45) Date of Patent: Jul. 16, 2024

(54) SHEET DISPENSING DEVICE

(71) Applicant: MITSUBISHI HEAVY INDUSTRIES MACHINERY SYSTEMS, LTD., Kobe (JP)

(72) Inventors: Kazuhiro Ando, Kobe (JP); Masahiro Kinjo, Kobe (JP)

(73) Assignee: MITSUBISHI HEAVY INDUSTRIES MACHINERY SYSTEMS, LTD., Kobe (JP)

( * ) Notice: Subject to any disclaimer, the term of this patent is extended or adjusted under 35 U.S.C. 154(b) by 162 days.

(21) Appl. No.: 17/797,277

(22) PCT Filed: Feb. 16, 2021

(86) PCT No.: PCT/JP2021/005765
§ 371 (c)(1),
(2) Date: Aug. 3, 2022

(87) PCT Pub. No.: WO2021/172108
PCT Pub. Date: Sep. 2, 2021

(65) Prior Publication Data

US 2023/0339709 A1 Oct. 26, 2023

(30) Foreign Application Priority Data

Feb. 25, 2020 (JP) ..... 2020-029003

(51) Int. Cl.
*B65H 83/02* (2006.01)
*B65H 1/04* (2006.01)
(Continued)

(52) U.S. Cl.
CPC ..... *B65H 83/02* (2013.01); *B65H 1/04* (2013.01); *B65H 1/30* (2013.01); *B65H 5/006* (2013.01);
(Continued)

(58) Field of Classification Search
CPC ..... B65H 1/04; B65H 1/26; B65H 1/30; B65H 7/10; B65H 83/02; B65H 2301/33214;
(Continued)

(56) References Cited

U.S. PATENT DOCUMENTS 5,743,374 A * 4/1998 Monsees ..... B65H 1/30 414/349
6,247,694 B1 * 6/2001 Nonnemacher ..... B65H 1/30 271/157
(Continued)

FOREIGN PATENT DOCUMENTS

JP S59-78053 A 5/1984
JP S60-133849 U 9/1985
(Continued)

OTHER PUBLICATIONS

PCT/ISA/210, "International Search Report for PCT International Application No. PCT/JP2021/005765," Apr. 20, 2021.
(Continued)

*Primary Examiner* — Prasad V Gokhale
(74) *Attorney, Agent, or Firm* — HAUPTMAN HAM, LLP

(57) ABSTRACT

The present invention includes a lift portion lifting and inverting a sheet group including a plurality of stacked sheets and a conveyor portion that moves, along a conveying direction, each sheet transferred from the lift portion, wherein: the lift portion includes frames, a fork portion, an inversion mechanism turning the fork portion to lift and invert the sheet group, and a fork movement mechanism moving the fork portion; the lift portion is equipped with a width direction movement mechanism moving the sheet group in a width direction; and after the sheet group is mounted on the fork portion and before the sheet group is transferred to the conveyor portion, the width direction movement mechanism is controlled on the basis of detection
(Continued)

information from a position sensor to center the sheet group within a reference width direction range.

13 Claims, 11 Drawing Sheets

(51) Int. Cl.

| | |
|---|---|
| ***B65H 1/30*** | (2006.01) |
| ***B65H 5/00*** | (2006.01) |
| ***B65H 5/06*** | (2006.01) |
| ***B65H 7/10*** | (2006.01) |

(52) U.S. Cl.
CPC ..... *B65H 5/066* (2013.01); *B65H 7/10* (2013.01); *B65H 2301/33214* (2013.01); *B65H 2301/333* (2013.01); *B65H 2404/651* (2013.01); *B65H 2405/111* (2013.01); *B65H 2405/351* (2013.01)

(58) Field of Classification Search
CPC ..... B65H 2301/333; B65H 2404/65; B65H 2404/651; B65H 2405/111; B65H 2405/351
See application file for complete search history.

(56) References Cited

U.S. PATENT DOCUMENTS

| | | | | |
|---|---|---|---|---|
| 6,595,740 | B1 * | 7/2003 | Drake | B65H 1/00 271/157 |
| 2012/0099956 | A1 * | 4/2012 | Diehr | B65H 15/02 414/815 |

FOREIGN PATENT DOCUMENTS

| | | | |
|---|---|---|---|
| JP | S63-2858 | B2 | 1/1988 |
| JP | H04-75843 | U | 7/1992 |
| JP | H05-81131 | U | 11/1993 |
| JP | H05-85734 | U | 11/1993 |
| JP | 2000-233854 | A | 8/2000 |
| JP | 2002-347971 | A | 12/2002 |
| JP | 2002-356237 | A | 12/2002 |
| JP | 2008-247579 | A | 10/2008 |
| JP | 2015-044682 | A | 3/2015 |

OTHER PUBLICATIONS

PCT/IB/373 and PCT/ISA/237, "International Preliminary Report on Patentability with Written Opinion for PCT International Application No. PCT/JP2021/005765," Aug. 30, 2022.
Japan Patent Office "Office Action for Japanese Patent Application No. 2020-029003," Jul. 25, 2023.

* cited by examiner

FIG. 6A1
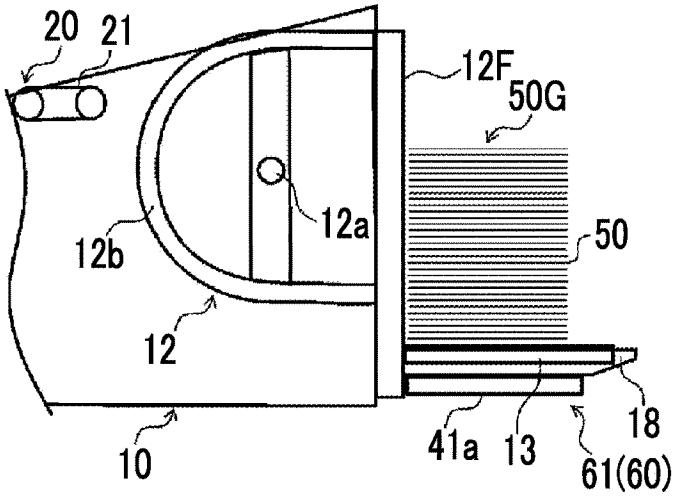
FIG. 6A2
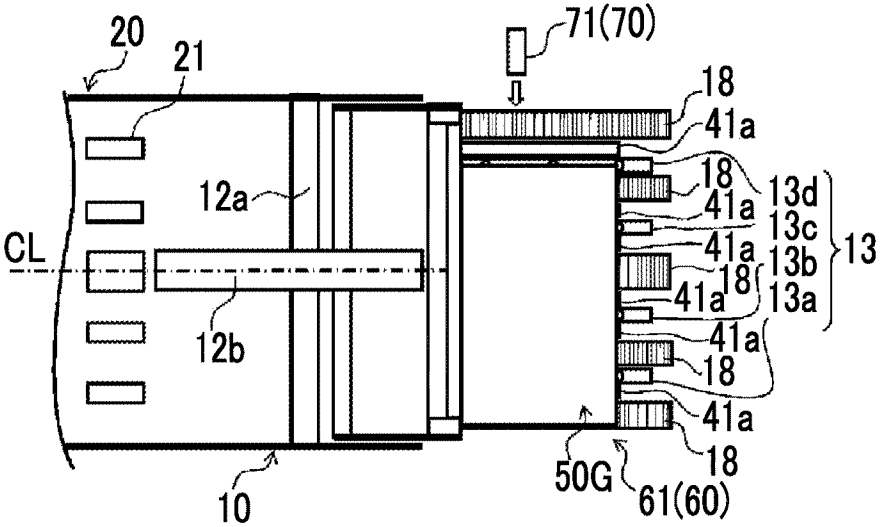
FIG. 6B1
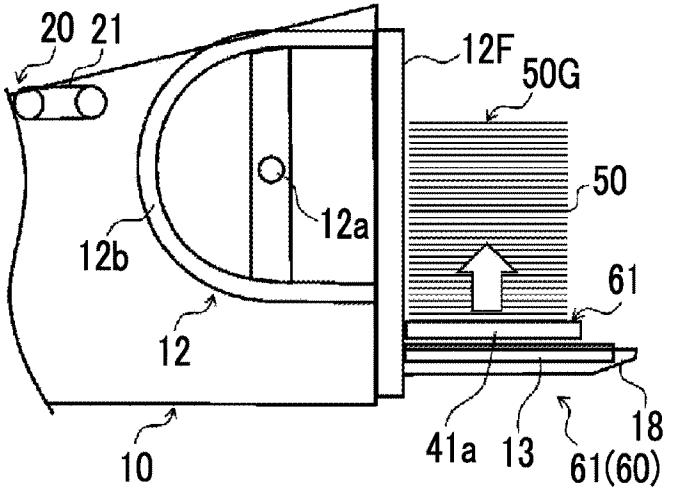
FIG. 6B2
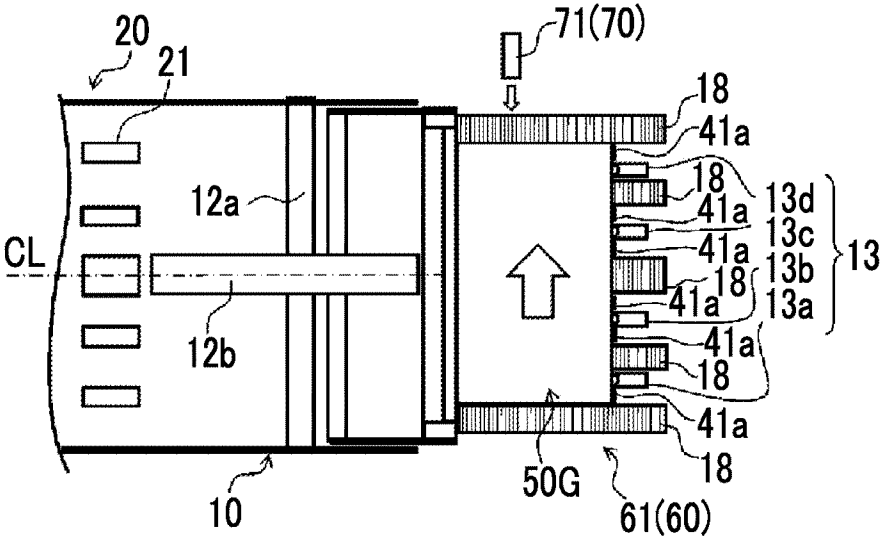

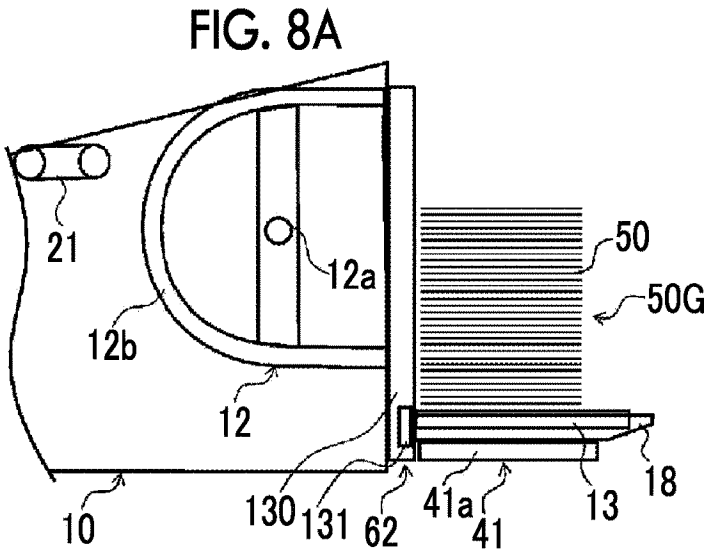
FIG. 8A
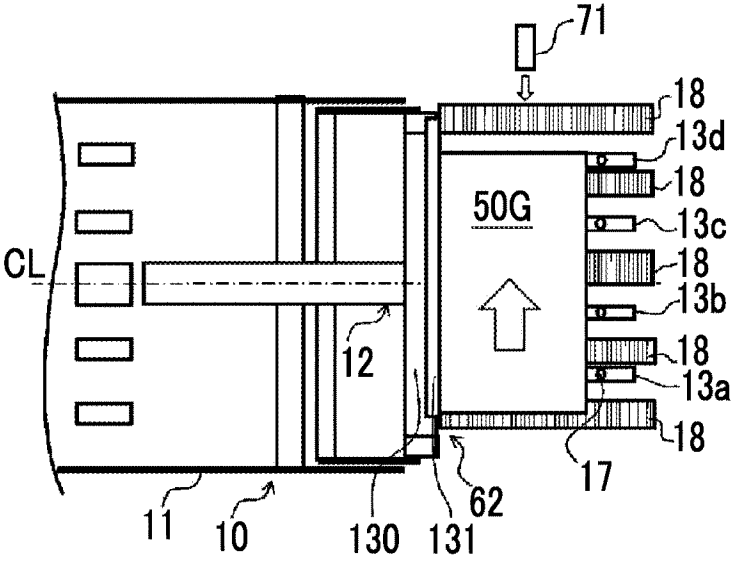
FIG. 8B1
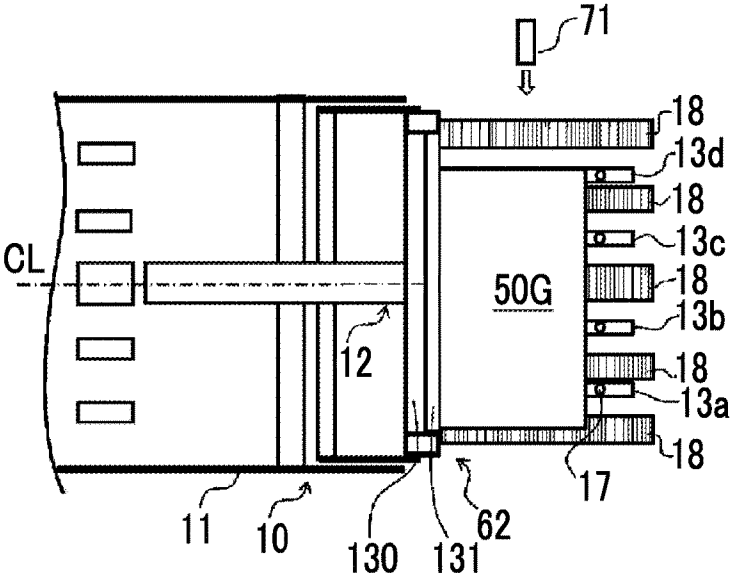
FIG. 8B1

SHEET DISPENSING DEVICE

RELATED APPLICATIONS

The present application is National Phase of International Application No. PCT/JP2021/005765 filed Feb. 16, 2021, and claims priority from Japanese Application No. 2020-029003, filed Feb. 25, 2020, the disclosure of which is hereby incorporated by reference herein in its entirety.

TECHNICAL FIELD

The present invention relates to a sheet supply device suitable for supplying a sheet such as a corrugated board from a supply source device such as a corrugated machine to a supply destination device such as a box making machine or a printing machine.

BACKGROUND ART

In the related art, as one of sheet supply devices for supplying sheets such as corrugated board from a supply source device such as a corrugated machine to a supply destination device such as a box making machine or a printing machine, there is known a sheet supply device having a configuration in which a sheet group including a plurality of flatly stacked sheets is lifted and, the front and back sides thereof are inverted, and the sheet group is transferred onto a conveyor, and the conveyor sequentially moves each sheet of the sheet group in a transport direction. This sheet supply device is also referred to as a prefeeder.

In the prefeeder, it is necessary to perform so-called centering in which the width-direction position of the sheet group is adjusted within an appropriate width-direction range at the stage of transferring each sheet onto the conveyor so that the sheet can be appropriately processed on the downstream side. Thus, a device (centering conveyor) for laterally moving and centering the sheet group is deployed upstream of the prefeeder. For example, PTL 1 discloses a lateral movement device that laterally moves and centers the sheet group.

CITATION LIST

Patent Literature

[PTL 1] Japanese Unexamined Utility Model Registration Application Publication No. 5-81131

SUMMARY OF INVENTION

Technical Problem

As described above, by deploying a centering device upstream of the prefeeder, each sheet can be appropriately processed on the downstream side, but an installation space for the centering device is required. For example, in the case of the centering conveyor, a conveyor having a length equal to or longer than the maximum sheet length in the sheet transfer direction is required. Therefore, the longitudinal size of the entire device becomes large and the factory layout is restricted.

The present invention has been invented focusing on such a problem, and an object of the present invention is to provide a sheet supply device capable of suppressing the longitudinal size of the entire device and securing the degree of freedom in factory layout. In addition, not limited to this object, another object of the present case is to exhibit actions and effects derived by respective configurations shown in the embodiments for carrying out the invention described below, and exhibit actions and effects that cannot be obtained by the related art.

Solution to Problem (1) A sheet supply device of the present case is a sheet supply device including a lift portion that lifts and inverts a sheet group including a plurality of flatly stacked sheets; and a conveyor portion that moves each sheet of the sheet group transferred from the lift portion in a transport direction. The lift portion is configured to include a frame that extends in a flat stacking direction of the sheet group, a fork portion that is supported by the frame so as to be movable in the flat stacking direction and has the sheet group mounted thereon, an inversion mechanism that turns the fork portion to lift and invert the mounted sheet group, and a fork movement mechanism that moves the fork portion in the flat stacking direction. The sheet supply device further comprises a width-direction movement mechanism that is equipped on the lift portion and moves the mounted sheet group in a width direction; a position sensor that detects a width-direction position of the sheet group; and a centering control device that controls the width-direction movement mechanism on the basis of detection information of the position sensor, and centers the width-direction position of the sheet group within a reference width-direction range, from when the sheet group is mounted on the fork portion to when the sheet group is transferred to the conveyor portion.

(2) Preferably, the width-direction movement mechanism is a roller conveyor device including a roller that is disposed below the lowered fork portion at an initial position and is lifted and moved vertically upward from the fork portion at the initial position to support the sheet group to move the sheet group in the width direction.

(3) Preferably, a dispensing device that moves a lowermost layer sheet of the sheet group in the width direction and dispenses the lowermost layer sheet to a lateral side of the dispensing device is applied to the roller conveyor device.

(4) Preferably, when the fork portion is at the initial position, the centering control device controls the roller conveyor device on the basis of the detection information of the position sensor and centers the width-direction position of the sheet group within the reference width-direction range.

(5) Preferably, when the fork portion is lifted from the initial position, the centering control device controls the roller conveyor device on the basis of the detection information of the position sensor and centers the width-direction position of the sheet group within the reference width-direction range.

(6) Preferably, the fork portion includes a fork portion body on which the sheet group is mounted, a support that movably supports the fork portion body in the width direction, and a fork portion movement mechanism that moves the fork portion body in the width direction with respect to the support to move the mounted sheet group in the width direction, and the width-direction movement mechanism is the fork portion movement mechanism.

(7) Preferably, the centering control device controls the fork portion movement mechanism on the basis of the detection information of the position sensor while the fork portion is lifted or inverted, and centers the width-direction position of the sheet group within the reference width-direction range.

(8) Preferably, the width-direction movement mechanism is a frame movement mechanism that moves the frame in the width direction to move the mounted sheet group in the width direction.

(9) Preferably, the sheet supply device further includes two rails that extend in the width direction; and a movable base frame that is equipped on the two rails so as to be movable in the width direction and forms a part of the frame, and the frame movement mechanism moves the movable base frame in the width direction to move the mounted sheet group in the width direction.

(10) Preferably, the sheet supply device further includes a gripping type movement mechanism that grips the sheet group to move the sheet group in the width direction when the sheet group is at a lifted and inverted position, and the gripping type movement mechanism is applied to the width-direction movement mechanism.

(11) Preferably, the sheet supply device further includes a transfer sheet support that is provided so as to face the fork portion when the sheet group is at a lifted and inverted position, and grips the sheet group from both end sides in the flat stacking direction in cooperation with the fork portion to guide the transfer of the sheet group to the conveyor portion, and the gripping type movement mechanism includes the fork portion and the transfer sheet support.

(12) Preferably, the lift portion includes a transfer control device that controls the inversion mechanism and the fork movement mechanism, the width-direction movement mechanism includes a moving body that moves in the width direction to move the sheet group in the width direction, the transfer control device performs initial position return control of returning the fork portion to the initial position after the transfer of the sheet group to the conveyor portion is completed, and the centering control device performs neutral position return control of returning the moving body to a neutral position in the width direction during the initial position return control.

(13) Preferably, the reference width-direction range is within a range of ±50 mm with respect to a width-direction reference position.

Advantageous Effects of Invention

According to the present case, since the width-direction movement mechanism related to the centering of the sheet group is equipped in the lift portion of the sheet supply device, the longitudinal size of the entire device can be suppressed and the degree of freedom in the factory layout can be secured.

BRIEF DESCRIPTION OF DRAWINGS

FIG. 1A is a schematic side view thereof, and FIG. 1B is a schematic plan view thereof.

FIG. 2A shows a non-operating state of a dispensing device, and FIG. 2B shows an operating state of the dispensing device.

FIGS. 6A1, FIG. 6A2, FIG. 6B1, and FIG. 6B2 are views of principal portions of a sheet supply device illustrating a configuration of a width-direction movement mechanism of the sheet supply device according to a first embodiment, FIG. 6A1 is a schematic side view showing a state before the start of centering control, FIG. 6A2 is a schematic plan view showing the state before the start of the centering control, FIG. 6B1 is a schematic side view showing a state during the centering control, and FIG. 6B2 is a schematic plan view showing a state during the centering control.

FIG. 7A is a view showing the state before the start of the centering control, FIG. 7B is a view showing the state during the centering control, and FIG. 7C is a view showing the state during the centering control.

FIGS. 8A, 8B1, and 8B2 are views of principal portions of a sheet supply device illustrating a configuration of a width-direction movement mechanism of the sheet supply device according to a second embodiment, FIG. 8A is a schematic side view thereof, FIG. 8B1 is a schematic plan view showing a state before the start of centering control, and FIG. 8B2 is a schematic plan view showing a state after the centering control.

FIG. 9A is a schematic side view thereof, and FIG. 9B is a schematic plan view thereof.

FIG. 10A is a view showing a state before the start of centering control, and FIG. 10B is a view showing a state after the centering control.

FIG. 11A is a schematic side view thereof, and FIG. 11B is a schematic plan view thereof.

FIG. 12A is a view showing a state before the start of centering control, and FIG. 12B is a view showing a state after the centering control.

DESCRIPTION OF EMBODIMENTS

Sheet supply devices as embodiments will be described with reference to the drawings. The embodiments shown below are merely examples, and there is no intention of excluding the application of various modifications and techniques not described clearly in the following embodiments. The respective configurations of the embodiments can be variously modified and implemented without departing from the spirit thereof. Additionally, the respective configurations can be selected as necessary or can be combined appropriately.

First, a configuration common to the respective embodiments will be described.

[1. Device Configuration]

Figure 1A:
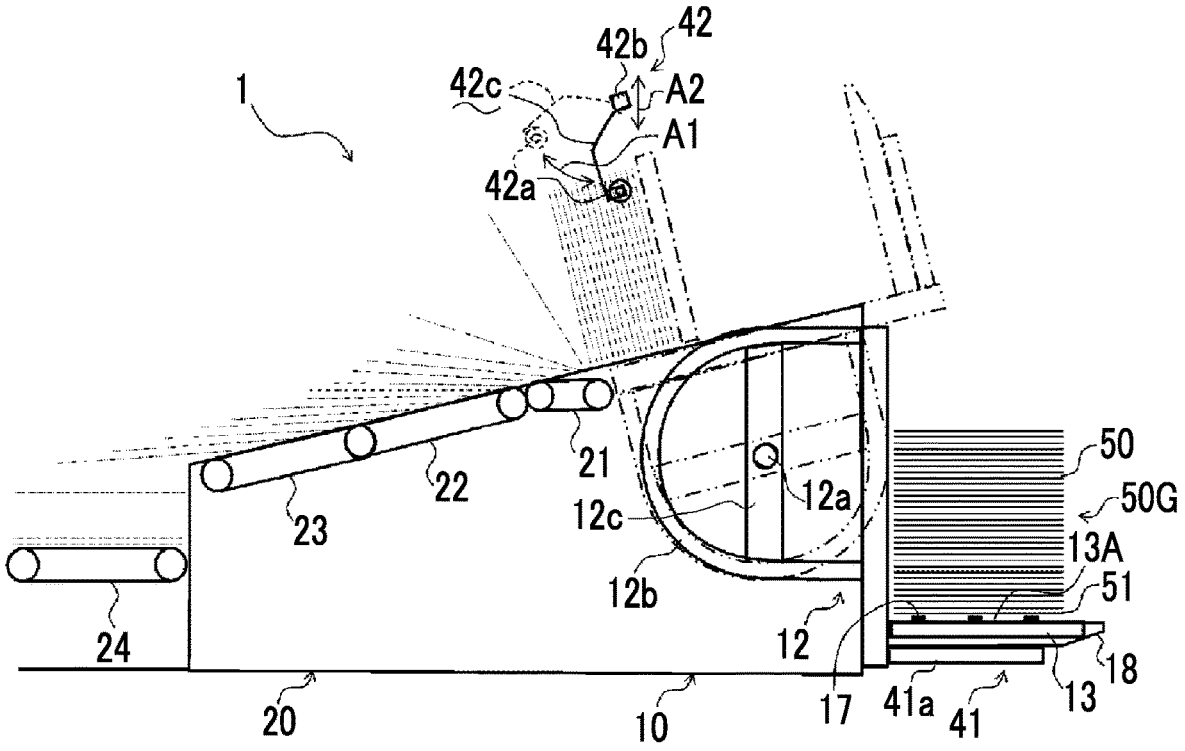
FIGS. 1A and 1B are views illustrating an overall configuration of a sheet supply device according to each embodiment.
Figure 1B:
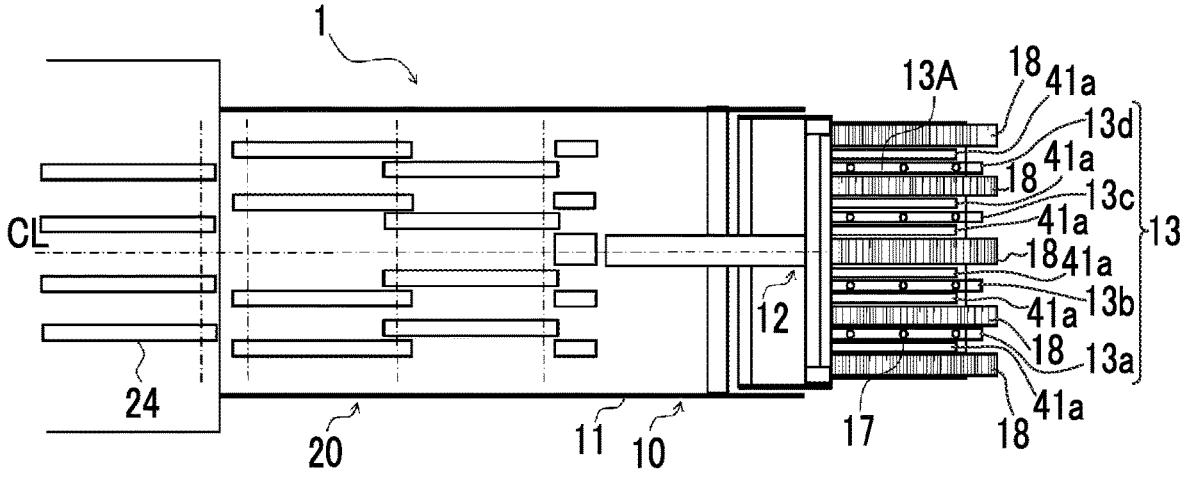

FIGS. 1A and 1B are a schematic side view and a schematic plan view illustrating an overall configuration of a sheet supply device according to each embodiment. The directions (up, down, upstream, downstream) in the figures represent directions based on a transport direction of the sheet supply device. Normally, since the sheet supply device is installed on a horizontal plane, the up-down direction of the sheet supply device coincides with the vertical direction. Additionally, the horizontal direction orthogonal to the transport direction is referred to as a device width direction (or simply a "width direction"). Additionally, the downstream side in the transport direction is referred to as the front, and the upstream side is referred to as the rear.

The sheet supply device 1 (hereinafter, also simply referred to as a "supply device") is deployed between a supply source device and a supply destination device, for example, between a corrugated machine (not shown) that manufactures a corrugated board and a box making machine (not shown) that processes the corrugated board into a box-making sheet material, and is used to supply a plurality of the corrugated boards manufactured by the corrugated machine to the box making machine. In each embodiment, each sheet 50 constituting a plurality of sheets (hereinafter referred to as a "sheet group") 50G is thick paperboard such as the corrugated board.

As shown in FIGS. 1A, 1B, 2A, and 2B, the supply device 1 is configured as a sheet inversion type supply device, and includes a lift portion 10 a sheet group 50G in which a plurality of sheets 50 are stacked flat is mounted, and a conveyor portion 20 provided downstream of the lift portion 10. The lift portion 10 lifts and inverts the mounted sheet group 50G to transfer the sheet group to a portion directly upstream of the conveyor portion 20. The conveyor portion 20 moves the sheet group 50G in a transport direction.

In addition, a direction in which the plurality of sheets 50 are stacked flat is referred to as a flat stacking direction.

[2. Lift Portion Configuration]

Figure 4:
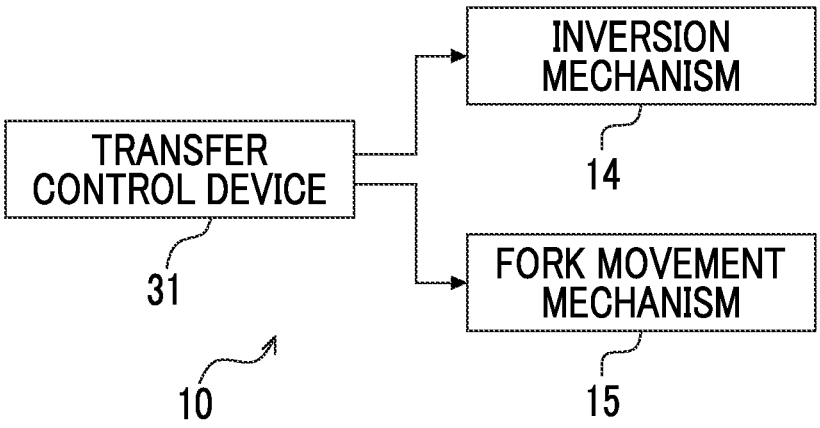
FIG. 4 is a block diagram illustrating a control configuration of an operating mechanism of the sheet supply device according to each embodiment.

As shown in FIGS. 1A, 1B, 2A, and 2B, the lift portion 10 includes a fixed frame 11, a movable frame 12 having a frame portion that is rotatably supported by the fixed frame 11 via a rotating shaft 12*a* extending in the horizontal direction and extends in a flat stacking direction, and a fork portion 13 that is slidably supported by the movable frame 12 in the flat stacking direction and has the sheet group 50G mounted thereon. Moreover, as shown in FIG. 4, the lift portion 10 is configured to include an inversion mechanism 14 that turns the fork portion 13 around a horizontal axis to lift and invert the mounted sheet group 50G, a fork movement mechanism 15 that slidably moves the fork portion 13 in the flat stacking direction, and a transfer control device 31 that controls the inversion mechanism 14 and the fork movement mechanism 15.

In addition, the posture of the sheet group 50G mounted on the fork portion 13 changes depending on the state of the lift portion 10, and as shown by a solid line in FIG. 1A, when the sheet group 50G is initially mounted (before the start of lifting and inverting), each sheet 50 is in a horizontal or substantially horizontal state, that is, a state in which the flat stacking direction faces a vertical or substantially vertical direction (vertical posture). As shown by a two-dot chain line in FIG. 1A, when the lifting and inverting by the inversion mechanism 14 is completed, each sheet 50 is inclined slightly downward from the vertical direction, that is, the flat stacking direction is inclined slightly downward from the horizontal (a forwardly inclined posture).

Here, the state of the lift portion 10 in which the sheet group 50G is in the vertical posture is referred to as an initial state, the state of the lift portion 10 in which the sheet group 50G is in the forwardly inclined posture is referred to as an inversion completion state, and a state in the middle of the initial state to the inversion completion state is referred to as a transfer state.

Additionally, the position of a moving element (moving body) of the lift portion 10 in the initial state is referred to as an initial position, and the position of the moving element (moving body) of the lift portion 10 in the inversion completion state is referred to as an inversion completion position.

The movable frame 12 includes pillars 12A and 12B on both sides in the device width direction and a plurality (here, four) elongated pillars 12C to 12F disposed between the pillars the 12A and 12B, as frame portions extending in the flat stacking direction. All the pillars 12A to 12F extend in the flat stacking direction and are disposed parallel to each other. Additionally, an elongated plate-shaped member 16 extending in the flat stacking direction is interposed between the pillars 12A to 12F.

The pillars 12A to 12F and the plate-shaped member 16 constitute a support surface 16F that supports a leading edge surface of the sheet group 50G. The leading edge surface of the sheet group 50G is a surface constituted of a sheet edge portion facing forward before inversion and facing downward after inversion, and is a surface perpendicular to the flat stacking direction. When the sheet group 50G is lifted and inverted by the inversion mechanism 14, the support surface 16F gradually receives the load of the sheet group 50G through the leading edge surface of the sheet group 50G so as to support the sheet group 50G.

The fork portion 13 is provided on the support surface 16F side (front side) of the movable frame 12, an arc-shaped arch portion 12*b* is provided on a back side of the movable frame 12, and a girder portion 12*c* erected in the arc of the arch portion 12*b* is provided with the rotating shaft 12*a* that rotatably supports the movable frame 12.

The fork portion 13 is cantileveredly supported by the movable frame 12 so as to protrude in a direction perpendicular to the support surface 16F. Here, the fork portion 13 is constituted of four rod-shaped arm portions 13*a* to 13*d* parallel to each other. The fork portion 13 (arm portions 13*a* to 13*d*) has a mounting surface 13A facing vertically upward in the initial state, and the sheet group 50G is mounted on the mounting surface 13A. The mounting surface 13A is equipped with a plurality of suction portions 17 for suctioning the sheet 50 (referred to as a lowermost sheet 51) located on the lowermost side of the sheet group 50G. As the suction portion 17, for example, a vacuum pad that suctions the lowermost sheet 51 by a suction force caused by vacuum can be applied.

A total of five lift conveyors 18 are cantileveredly fixed to the movable frame 12 between the arm portions 13*a* to 13*d* of the fork portion 13 and outside the arm portions 13*a* to 13*d*. Each lift conveyor 18 has a support surface facing vertically upward in the initial state, and the support surface of each lift conveyor 18 is provided with a conveyor 18A that transports the sheet group 50G to the mounting surface 13A of the fork portion 13. For example, a roller conveyor can be applied to the conveyor 18A, and when the sheet group 50G is supplied from the corrugated machine (not shown), the sheet group 50G is transported to a position where the sheet group 50G hits the support surface 16F of the movable frame 12 on a forward end side in the transport direction by the conveyor 18A.

Although not shown in FIGS. 1A, 1B, 2A, and 2B, the inversion mechanism 14 is configured to include a motor and a speed reducer provided on the fixed frame 11 side, and the movable frame 12 is rotated around the rotating shaft 12*a* horizontal to the fixed frame 11 to turn the fork portion 13 supported by the movable frame 12 around the horizontal axis, whereby the sheet group 50G mounted on the fork portion 13 is inverted while being lifted.

Although not shown in FIGS. 1A, 1B, 2A, and 2B, the fork movement mechanism 15 is configured to include a chain and a chain wheel partially built in the movable frame 12, and a motor that drives the chain wheel, and slidably moves the fork portion 13 with respect to the movable frame 12. This slide movement moves the fork portion 13 upward in the flat stacking direction with respect to the movable frame 12, and is performed in parallel with the lifting and inverting of the sheet group 50G by the inversion mechanism 14.

Such control of the inversion mechanism 14 and the fork movement mechanism 15 is performed by the transfer control device 31.

Additionally, when all the other sheets 51 have been supplied to the downstream side while leaving the lowermost sheet 51, the lift portion 10 returns from the inversion completion position to the initial position with the lowermost sheet 51 kept suctioned on the suction portion 17 of the fork portion 13, and releases the suction to eliminate the lowermost sheet 51. For this reason, a dispensing device 41 that eliminates the lowermost sheet 51 is provided.

As the dispensing device 41, a roller conveyor device is applied, including a plurality of rollers 41*a* disposed between the arm portions 13*a* to 13*d* of the fork portion 13 and the lift conveyor 18 in a plan view at the initial position.

The plurality of rollers 41*a* are all disposed parallel to the arm portions 13*a* to 13*d* and the lift conveyor 18 at the initial position, and are moved up and down in the vertical direction by an elevating mechanism (not shown). Additionally, at least some (here, all the rollers 41*a*) of the rollers 41*a* are rotated by a motor (not shown). The plurality of rollers 41*a* are always located at a retracted position vertically below the fork portion 13 so as not to interfere with the mounting of the sheet group 50G, and are is lifted to a use position vertically above the fork portion 13 to support and rotate the lowermost sheet 51 when performing dispensing processing is performed and by rotating, and thereby dispenses the lowermost sheet 51 to a lateral side of the device.

Additionally, when the inversion completion state is approached, the sheet on a tip side of the sheet group 50G (the sheet vertically above in the initial posture) may be tilted irrespective of before the supply to the downstream side due to an inertial force caused by the forward inclination and movement of the sheet group 50G. In order to prevent this tilting, as shown in FIGS. 1A, 2A, and 2B, a moving sheet support 42 is equipped to abut against the tip side of the sheet group 50G to cooperate with the moving fork portion 13 in the flat stacking direction and support the fork portion 13 to be sandwiched from both sides in the flat stacking direction.

The moving sheet support 42 includes a plurality of rollers 42*a* that abuts against the sheet on the tip side of the sheet group 50G. The plurality of rollers 42*a* are formed of a soft material such as resin so as to have a peripheral surface without angular portion so as to be capable of coming into soft contact with the sheet 50, and each arm 42*c* is rotatably equipped at the tip of the arm 42*c* rockably supported by the support 42*b*.

Figure 2A:
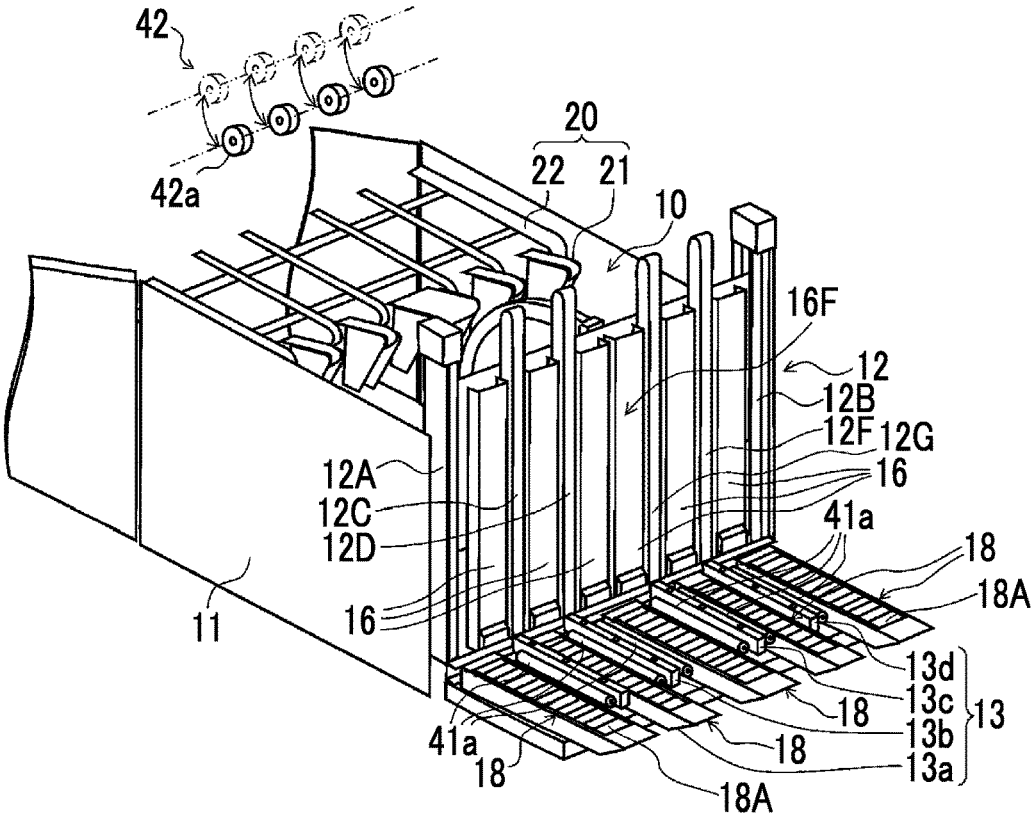
FIGS. 2A and 2B are enlarged perspective views showing a lift portion according to each embodiment.
Figure 2B:
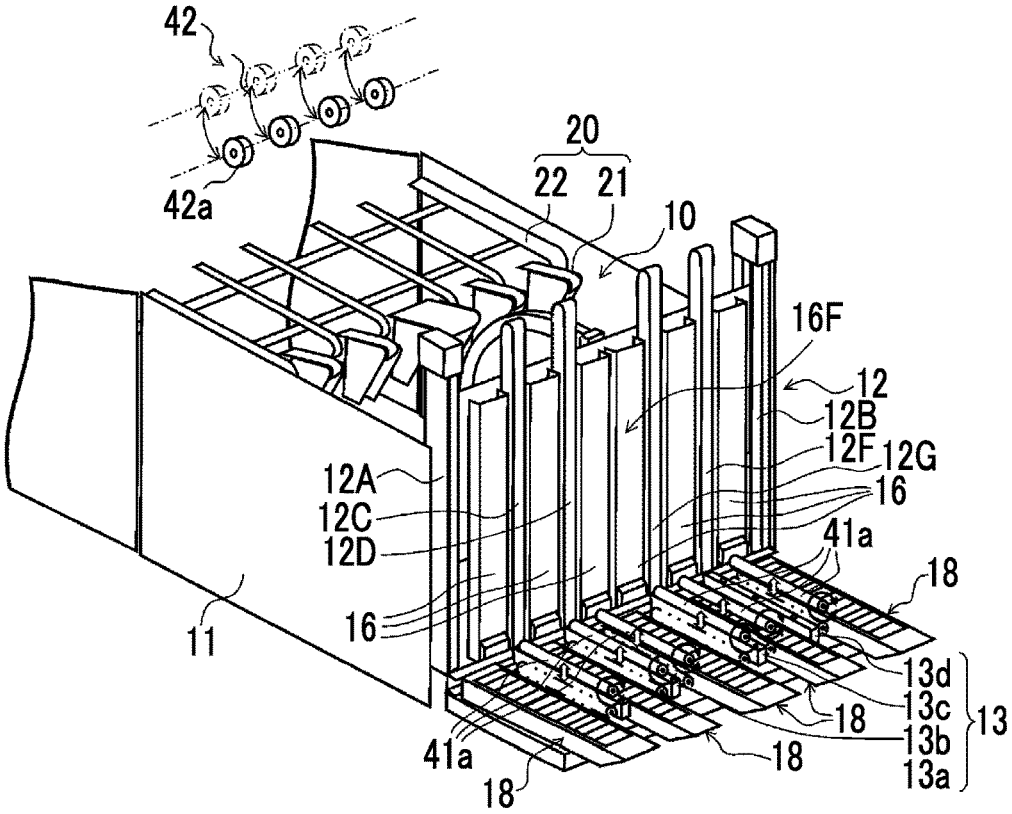

Each arm 42*c* is integrally rocked, as shown by an arrow A1 in FIG. 1A, by a drive device (not shown) such as a motor between the use position shown by the solid line and the retracted position shown by the two-dot chain line in FIGS. 1A, 2A, and 2B, so that the plurality of rollers 42*a* can simultaneously abut against the sheet on the tip side of the sheet group 50G at the use position, and the plurality of rollers 42*a* are retracted so as to be separated from the transfer path of the sheet group 50G at the retracted position. Additionally, the support 42*b* is moved up and down as shown by an arrow A2 in FIG. 1A by the elevating drive device (not shown) in conformity with the size of the sheet group 50G.

[3. Conveyor Portion Configuration]

Additionally, as shown in FIGS. 1A and 1B, the conveyor portion 20 includes a first conveyor 21, a second conveyor 22, and a third conveyor 23 from upstream to downstream in the transport direction, which are provided in order so as to follow a hopper 24 of the box making machine on the downstream side. The first conveyor 21, the second conveyor 22, the third conveyor 23, and the hopper 24 each have a plurality of pulleys and an endless belt, and are driven by a drive mechanism such as a motor (not shown) and sequentially transport the sheet group 50G placed on the endless belt from upstream to downstream in the transport direction.

[4. Actions]

Next, the actions of the supply device having the above configuration will be described. The operation of the respective portions of the supply device 1 described below is controlled on the basis of a control signal from a control unit (not shown).

Figure 3A:
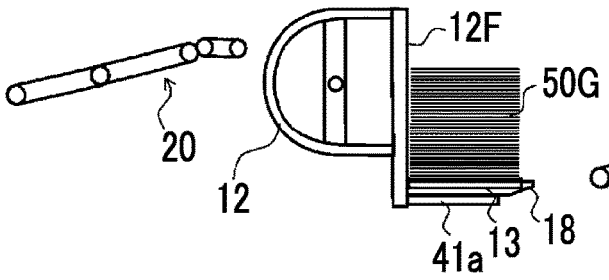
FIGS. 3A to 3E are views illustrating the operation of the sheet supply device according to each embodiment, and are schematic side views of principal portions of the sheet supply device that operates in order of FIGS. 3A to 3E.
Figure 3B:
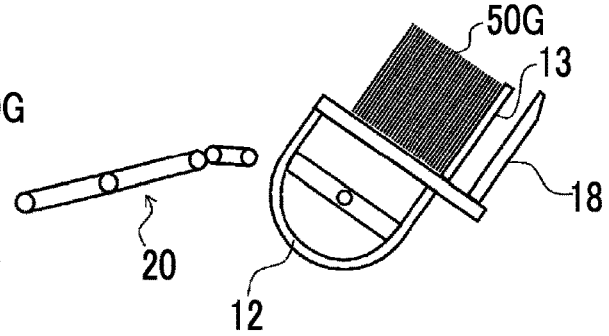
Figure 3C:
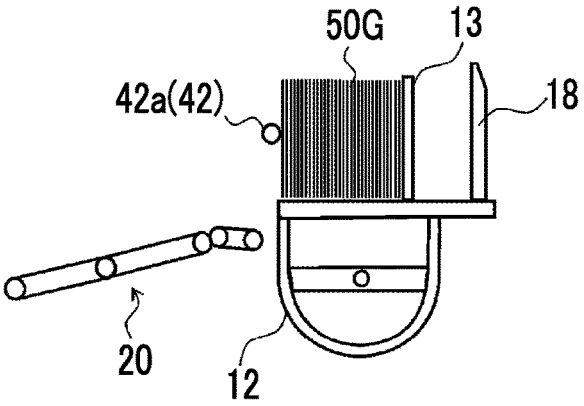
Figure 3D:
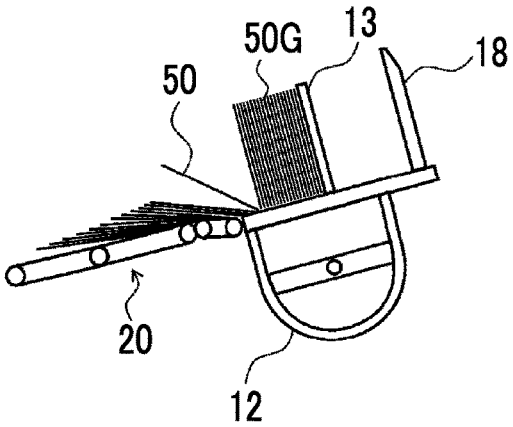
Figure 3E:
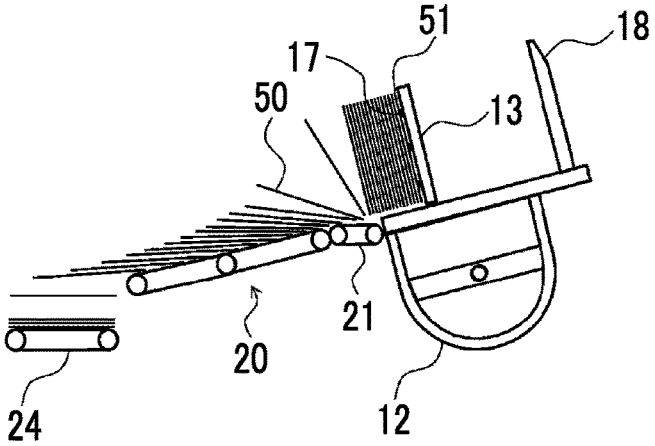

FIGS. 3A to 3E are schematic side views illustrating an aspect in which the lift portion 10 of the supply device is rotated from the vertical posture via a horizontal posture to the forwardly inclined posture, FIG. 3A shows a state in which the lift portion 10 is in the vertical posture, FIGS. 3B and 3C show the process in which the lift portion 10 is rotated from the vertical posture to the forwardly inclined posture, and FIGS. 3D and 3E show a state in which the lift portion 10 is rotated to the forwardly inclined posture.

First, the sheet group 50G is mounted in a flat stacking state on the fork portion 13 in the initial state shown in FIG. 3A.

Next, as shown in FIGS. 3B, 3C, 3D, and 3E, the lift portion 10 is rotated in the transport direction from a hanging posture to the forwardly inclined posture while moving the fork portion 13 upward from below in the flat stacking direction.

In the state shown in FIG. 3C, the moving sheet support 42 is utilized.

Then, in the state of the forwardly inclined posture shown in FIGS. 3D and 3E, the sheets 50 other than the lowermost sheet 51 are turned over and inverted in order from the sheet at the highest position toward the front in the transport direction, and are transferred to the first conveyor 21. However, the lowermost sheet 51 remains on the fork portion 13 due to the suction of the suction portion 17, and is not transferred onto the first conveyor 21.

[5. Configuration Related to Centering]

In the sheet supply device configured in this way, it is necessary to perform so-called centering in which the width-direction position of a sheet group is adjusted within a reference width-direction range so that each sheet 50 can be appropriately supplied to the downstream side (box making machine). In addition, in each embodiment, the reference width-direction range is set within a range of ±50 mm with respect to a width-direction reference position (a width-direction center CL of the device).

Figure 5:
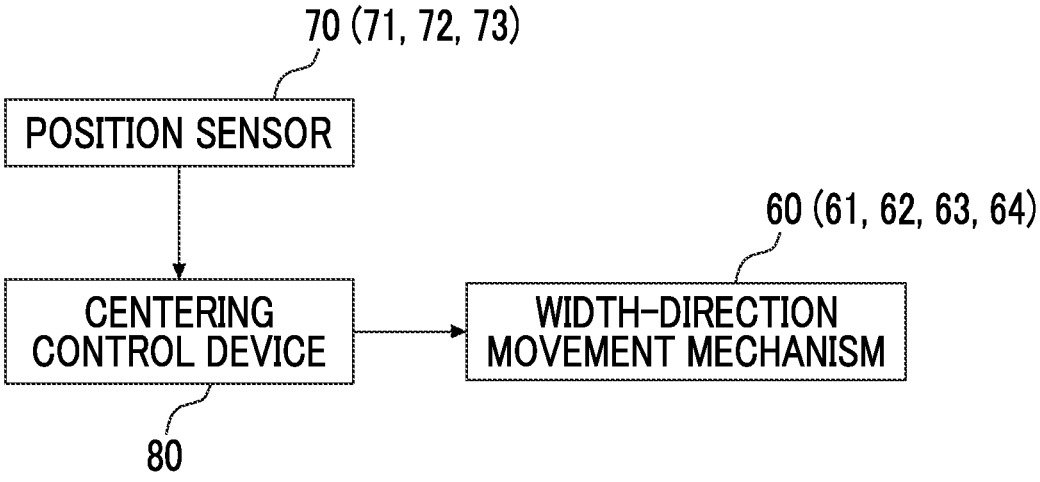
FIG. 5 is a block diagram illustrating a configuration of a centering control device of the sheet supply device according to each embodiment.

Thus, as shown in FIG. 5, the present device is equipped with a width-direction movement mechanism 60 that moves the mounted sheet group 50G in the width direction, a position sensor 70 that detects the width-direction position of the sheet group, and a centering control device 80 that controls the width-direction movement mechanism 60 on the basis of the detection information of the position sensor 70 and centers the width-direction position of the sheet group 50G within the reference width-direction range.

The present case has a feature in that the centering is performed in the sheet supply device. However, first to fourth embodiments in which the specific configurations of the width-direction movement mechanisms 60 are different from each other will be described herein.

First Embodiment

As shown in FIGS. 5 and 6A1, FIG. 6A2, FIG. 6B1, and FIG. 6B2, a device related to the centering according to the present embodiment includes a roller conveyor device 61 as the width-direction movement mechanism, an initial position sensor 71 as the position sensor, the centering control device 80.

In this case, the roller conveyor device 61 according to the present embodiment appropriately uses the above dispensing device 41 including the rollers 41*a*, which are disposed below the fork portion 13 at the initial position and are lifted and moved vertically upward from the fork portion 13 at the initial position to support the sheet group 50G to move the sheet group 50G in the width direction.

As described above, the dispensing device 41 includes a plurality of rollers 41*a* disposed between the arm portions 13*a* to 13*d* of the fork portion 13 and the lift conveyor 18 in a plan view at the initial position, and the plurality of rollers 41*a* are provided are all disposed parallel to the arm portions 13*a* to 13*d* and the lift conveyor 18 at the initial position, are moved up and down in the vertical direction by the elevating mechanism (not shown), and are rotated by the motor (not shown).

The plurality of rollers 41*a* are driven up to move up and down between the retracted position vertically below the fork portion 13 and the use position vertically above the fork portion 13, the dispensing device 41 is lifted to the use position and used when the lift portion 10 returns from the inversion completion position the initial position to eliminate the lowermost sheet 51. However, the roller conveyor device 61 is lifted to the use position and used immediately after the lift portion 10 is at the initial position and the sheet group 50G is mounted on the fork portion 13.

That is, when the sheet group 50G is mounted on the fork portion 13, the initial position sensor 71 detects the distance from a side edge portion of the sheet group 50G. Data of the size in the device width direction when the sheet group 50G is mounted is input to the centering control device 80. In the centering control device 80, the positional deviation of the center of the sheet group 50G in the width direction with respect to the width-direction center CL of the device can be calculated from the position of the side edge portion of the sheet group 50G detected by the initial position sensor 71.

The centering control device 80 determines whether or not the magnitude of the positional deviation is within a predetermined error range (the error range is, for example, ±50 mm), and when the magnitude of the positional deviation exceeds the predetermined error range, the roller conveyor device 61 is controlled to move the sheet group 50G in the width direction such that the magnitude of the positional deviation is within the predetermined error range.

For example, as shown in FIGS. 6A1 and 6A2, when the sheet group 50G positionally deviates to the left by an error range or more with respect to the transport direction (the direction from right to left in the figures), the roller conveyor device 61 (dispensing device) 41 is controlled to move the sheet group 50G to the right as shown in FIGS. 6B1 and 6B2.

Figure 7A:
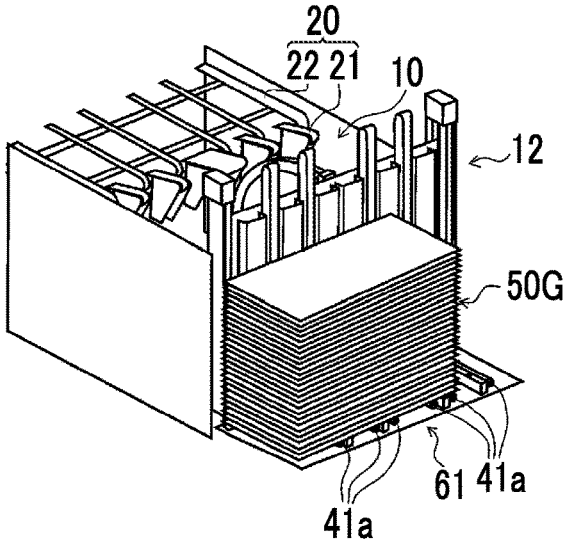
FIGS. 7A, 7B, and 7C are perspective views of the principal portions of the sheet supply device illustrating the configuration of the width-direction movement mechanism of the sheet supply device according to the first embodiment.
Figure 7B:
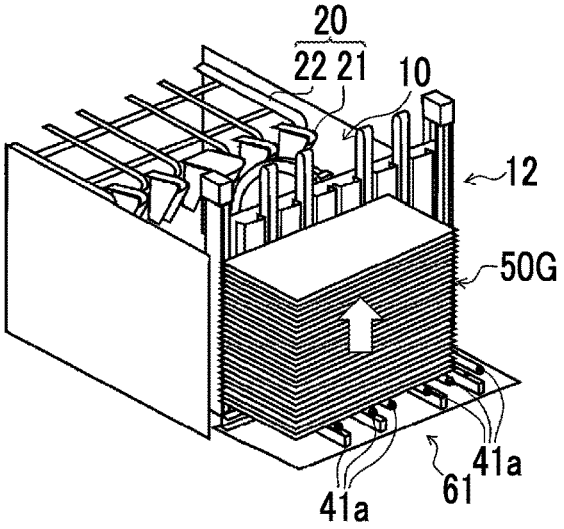
Figure 7C:
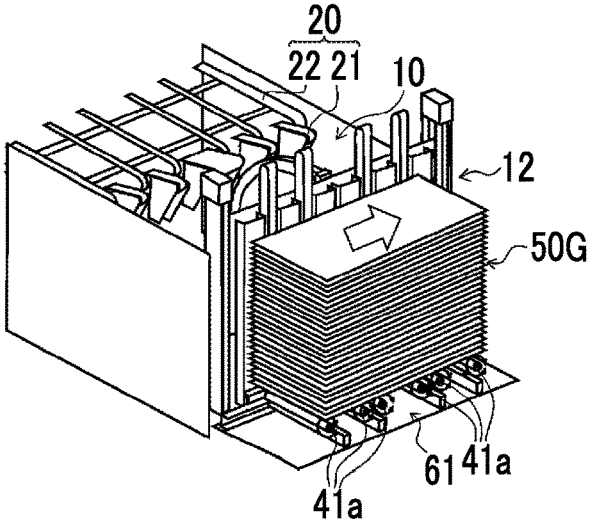

Specifically, the plurality of rollers 41*a* are lifted from the retracted position vertically below the fork portion 13 as shown in FIG. 7A to the use position vertically above the fork portion 13 as shown in FIG. 7B to bring about a state in which the sheet group 50G is supported by the plurality of rollers 41*a*, and as shown in FIG. 7C, the plurality of rollers 41*a* is rotated by a predetermined amount in a predetermined direction to move the sheet group 50G by a predetermined amount of rotation in a predetermined direction. After the movement, the plurality of rollers 41*a* are lowered to the retracted position. In addition, in FIGS. 7A and 7B, the description of the lift conveyor 18 is omitted.

According to the present embodiment, in the lift portion 10, the existing dispensing device 41 is utilized to suppress an increase in the longitudinal size of the entire device to secure the degree of freedom in the factory layout, and to suppress an increase in cost while performing the centering of the sheet group 50G.

In addition, the centering of the sheet group 50G can be implemented by effectively utilizing the dispensing device 41 not only while the sheet group 50G is mounted on the fork portion 13 and the lift portion 10 is at the initial position but also until the fork portion 13 starts turning and lifting and the fork portion 13 moves above the plurality of rollers 41*a*.

Therefore, the centering control device 80 may stop the lift portion 10 at the initial position to reliably perform the centering of the sheet group 50G, but may perform the centering of the sheet group 50G utilizing the time until the fork portion 13 starts turning and lifting and the fork portion 13 moves above the plurality of rollers 41*a*. In this case, the time from the centering of the sheet group 50G to the completion of the inversion can be shortened.

In addition, in the present embodiment, the dispensing device 41 is utilized as the roller conveyor device 61, but the present invention is not limited to this. Some rollers 41*a* of the plurality of rollers 41*a* of the dispensing device 41 may be utilized as the roller conveyor device 61, or dedicated rollers may be separately disposed to constitute the roller conveyor device 61 without using the dispensing device 41.

Second Embodiment

In the present embodiment, as shown in FIGS. 8A, 8B1 and 8B2, the fork portion 13 includes a fork portion body 131 on which the sheet group 50G is mounted, a support 130 that movably supports the fork portion body 131 in the width direction, and a fork portion movement mechanism 62 that moves the fork portion body 131 in the width direction with respect to the support 130 to move the mounted sheet group 50G in the width direction using an actuator (not shown), and the fork portion movement mechanism 62 is applied to the width-direction movement mechanism 60. In addition, in FIGS. 8B1 and 8B2, the description of the rollers 41*a* of the dispensing device 41 is omitted.

As shown in FIG. 5, the device related to centering according to the present embodiment includes the fork portion movement mechanism 62 as the width-direction movement mechanism, the initial position sensor 71 as the position sensor, and the centering control device 80. Similar to the first embodiment, the centering control device 80 controls the fork portion movement mechanism 62 on the basis of the detection information of the initial position sensor 71, and centers the width-direction position of the sheet group 50G within the reference width-direction range.

That is, the support 130 is supported by the movable frame 12 so as to be slidable in the flat stacking direction, and the fork portion body 131 is supported by the support 130 so as to be movable in the width direction. The fork portion movement mechanism 62 can utilize, for example, a motor and a ball screw mechanism that converts the rotation of the motor into a linear motion, and can be configured by fixing the support 130 such that the axes of the motor and the ball screw shaft extend in the width direction and fixing a nut screwed to a ball screw shaft via a ball to the fork portion body 131.

Additionally, in the fork portion movement mechanism 62 as the width-direction movement mechanism 60, the fork portion body 131 is a moving body that moves in the width direction to move the sheet group 50G in the width direction. The transfer control device 31 (refer to FIG. 4) performs the initial position return control of returning the fork portion 10 to the initial position after the transfer of the sheet group 50G to the conveyor portion 20 is completed, but the centering control device 80 performs the neutral position return control of returning the fork portion body 131 as the moving body to a neutral position in the width direction during the initial position return control.

In this way, the lift portion 10 is provided with the fork portion movement mechanism 62, so that the centering of the sheet group 50G can be performed while suppressing the increase in the longitudinal size of the entire device to secure the degree of freedom in the factory layout.

Additionally, since the centering can be performed during the lifting and inverting of the sheet group 50G, the time from the centering of the sheet group 50G to the inversion completion state can be shortened.

Additionally, after the transfer of the sheet group 50G to the conveyor portion 20 is completed, the neutral position return control of returning the fork portion body 131 to the neutral position in the width direction is performed during the initial position return control of returning the fork portion 10 to the initial position. Thus, the centering of the next sheet group 50G can be performed without any trouble.

Third Embodiment

Figure 9A:
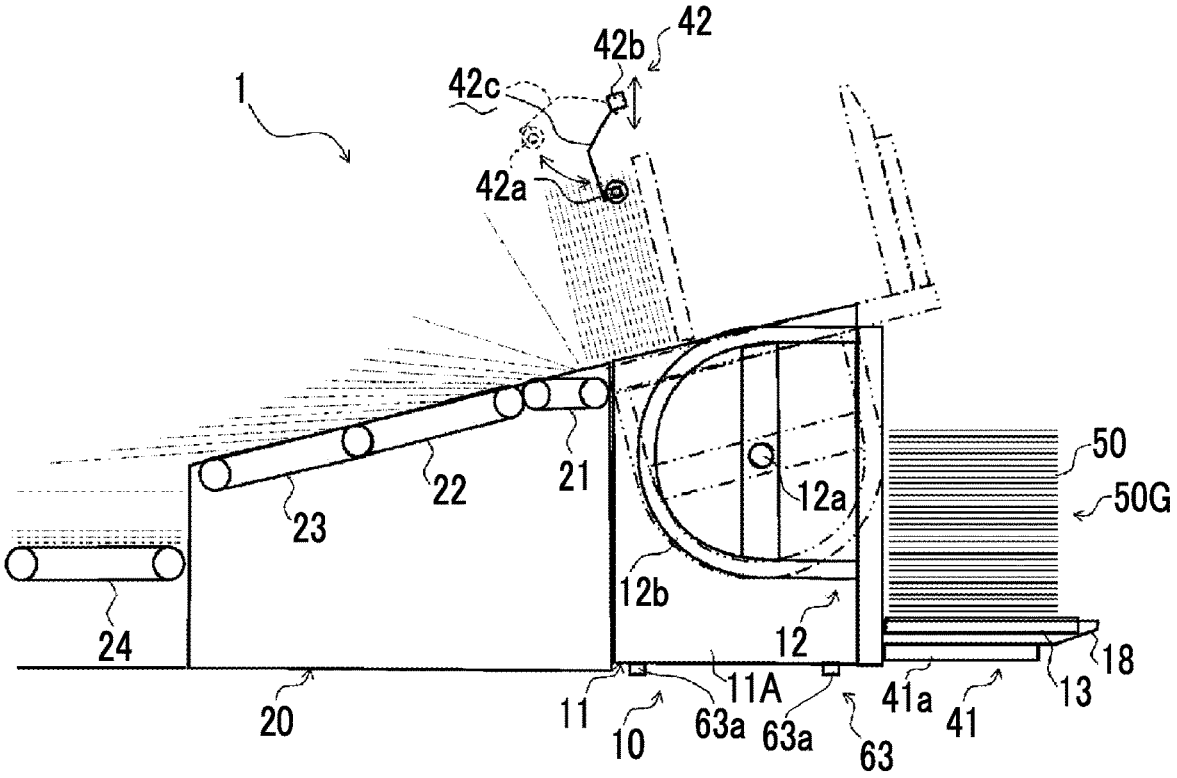
FIGS. 9A and 9B are views illustrating an overall configuration of a sheet supply device according to a third embodiment.
Figure 9B:
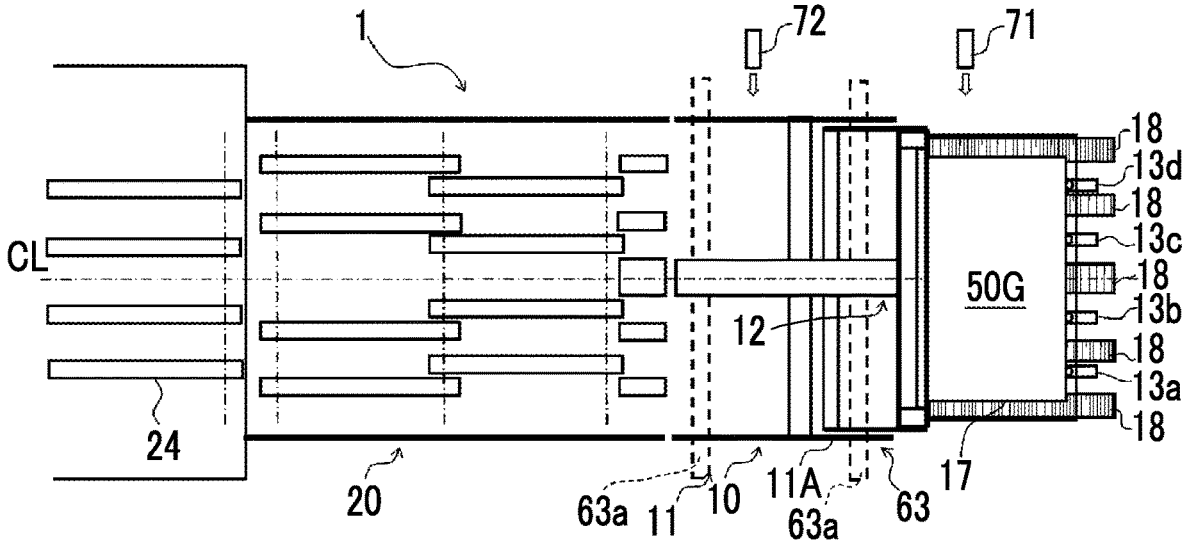

In the present embodiment, as shown in FIGS. 9A and 9B, a movable base frame 11A, which is a part of the fixed frame 11 of the lift portion 10, includes a frame movement mechanism 63 that is equipped on two rails 63*a* and 63*a*, extending in the device width direction, movable in the width direction, moves the movable base frame 11A in the width direction to move the mounted sheet group 50G in the width direction using an actuator (not shown), and the frame movement mechanism 63 is applied to the width-direction movement mechanism 60. In addition, in FIGS. 9B, 10A, and 10B, the description of the rollers 41*a* of the dispensing device 41 is omitted.

Figure 10A:
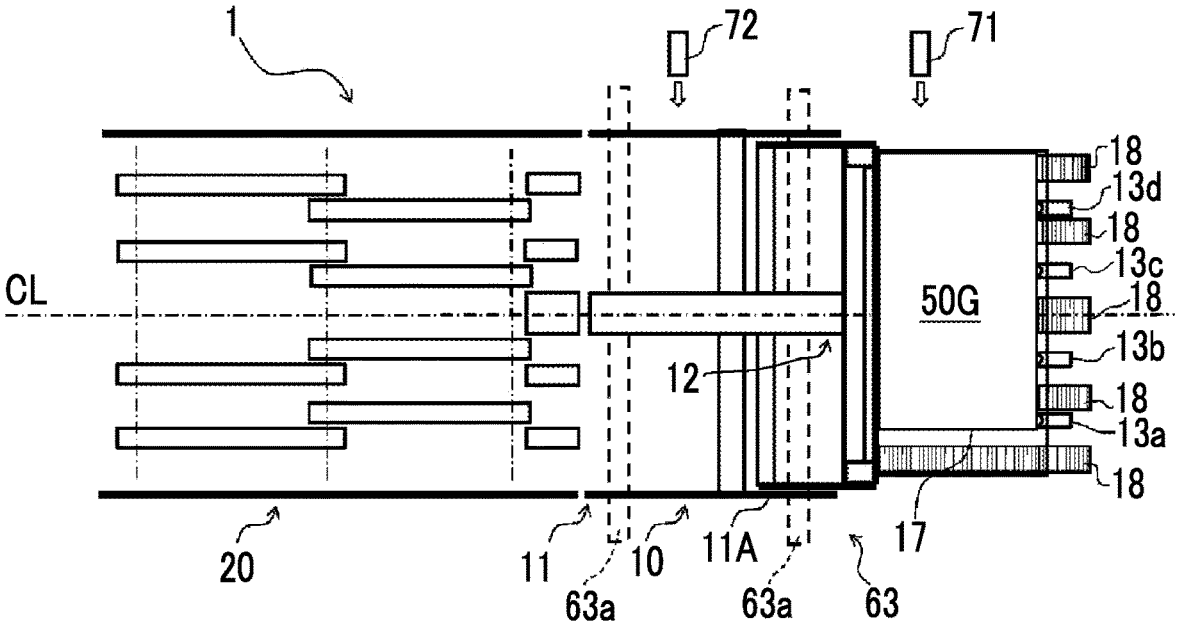
FIGS. 10A and 10B are schematic plan views of principal portions of the sheet supply device illustrating a configuration of a width-direction movement mechanism of the sheet supply device according to the third embodiment.
Figure 10B:
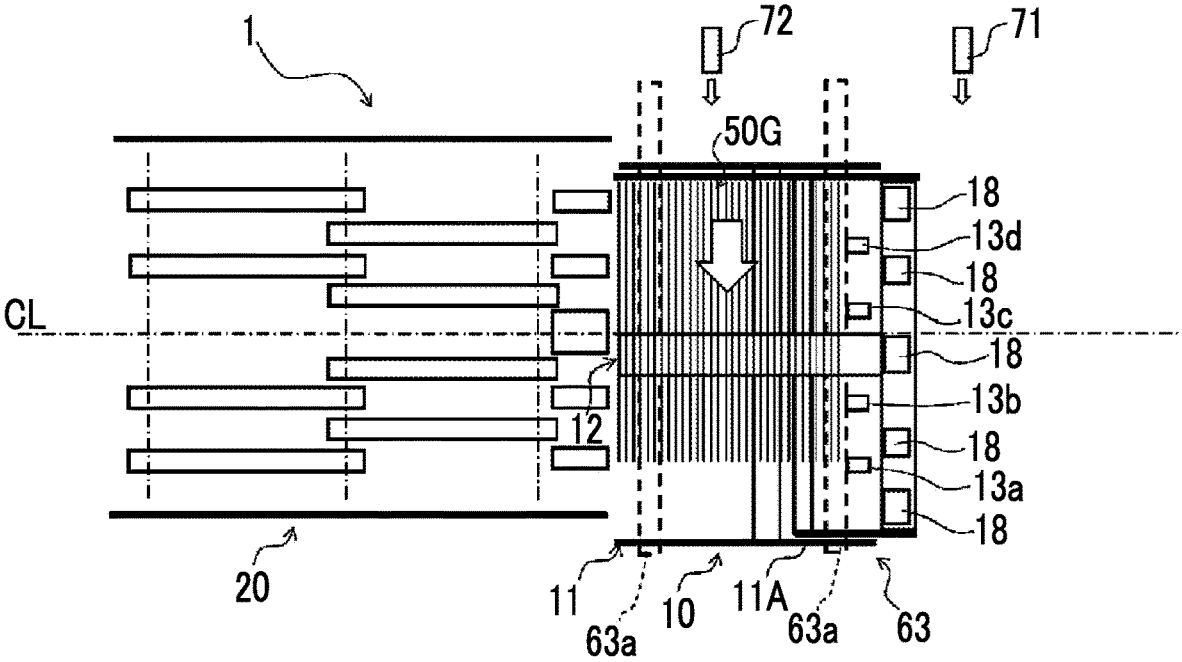

As shown in FIG. 5, the device related to centering according to the present embodiment includes the frame movement mechanism 63 as the width-direction movement mechanism, the initial position sensor 71 as the position sensor, an inversion completion position sensor 72, and the centering control device 80. Similar to the first and second embodiments, the centering control device 80 controls the frame movement mechanism 63 on the basis of the detection information of the initial position sensor 71 and the inversion completion position sensor 72, and as shown in FIGS. 10A and 10B, operates the frame movement mechanism 63 to center the width-direction position of the sheet group 50G within the reference width-direction range.

Here, the position of the sheet group 50G at the initial position is detected by the initial position sensor 71, a required width-direction movement amount of the sheet group 50G is calculated, and the frame movement mechanism 63 is controlled during the subsequent lifting and inverting movement to perform the centering of the sheet group 50G. The inversion completion position sensor 72 detects the position of the sheet group 50G at the stage of approaching the inversion completion position or the inversion completion position to confirm the centering result.

However, only one of the initial position sensor 71 and the inversion completion position sensor 72 may be equipped.

In a case where the initial position sensor 71 is equipped, the position of the sheet group 50G can be detected at an early stage, so that the time required for the centering can be sufficiently secured.

Additionally, in a case where the inversion completion position sensor 72 is equipped, the position of the sheet group 50G at a final stage can be detected, so that the allowance for the centering time is reduced, but the accuracy of the centering can be improved.

Additionally, in the frame movement mechanism 63 as the width-direction movement mechanism 60, the movable base frame 11A is a moving body that moves in the width direction to move the sheet group 50G in the width direction. Also in the present embodiment, after the transfer of the sheet group 50G to the conveyor portion 20 is completed, the transfer control device 31 performs the initial position return control of returning the fork portion 10 to the initial position, but the centering control device 80 performs the neutral position return control of returning the movable base frame 11A as the moving body to the neutral position in the width direction.

In this way, the movable base frame 11A, which is a part of the fixed frame 11, is included such that the frame movement mechanism 63 is movable in the width direction, so that the centering of the sheet group 50G can be performed while suppressing the increase in the longitudinal size of the entire device to secure the degree of freedom in the factory layout.

Additionally, since the centering can be performed during the lifting and inverting of the sheet group 50G, the time from the centering of the sheet group 50G to the inversion completion state can be shortened.

Additionally, after the transfer of the sheet group 50G to the conveyor portion 20 is completed, the neutral position return control of returning the movable base frame 11A to the neutral position in the width direction is performed during the initial position return control of returning the fork portion 10 to the initial position. Thus, the centering of the next sheet group 50G can be performed without any trouble.

Fourth Embodiment

Figure 11A:
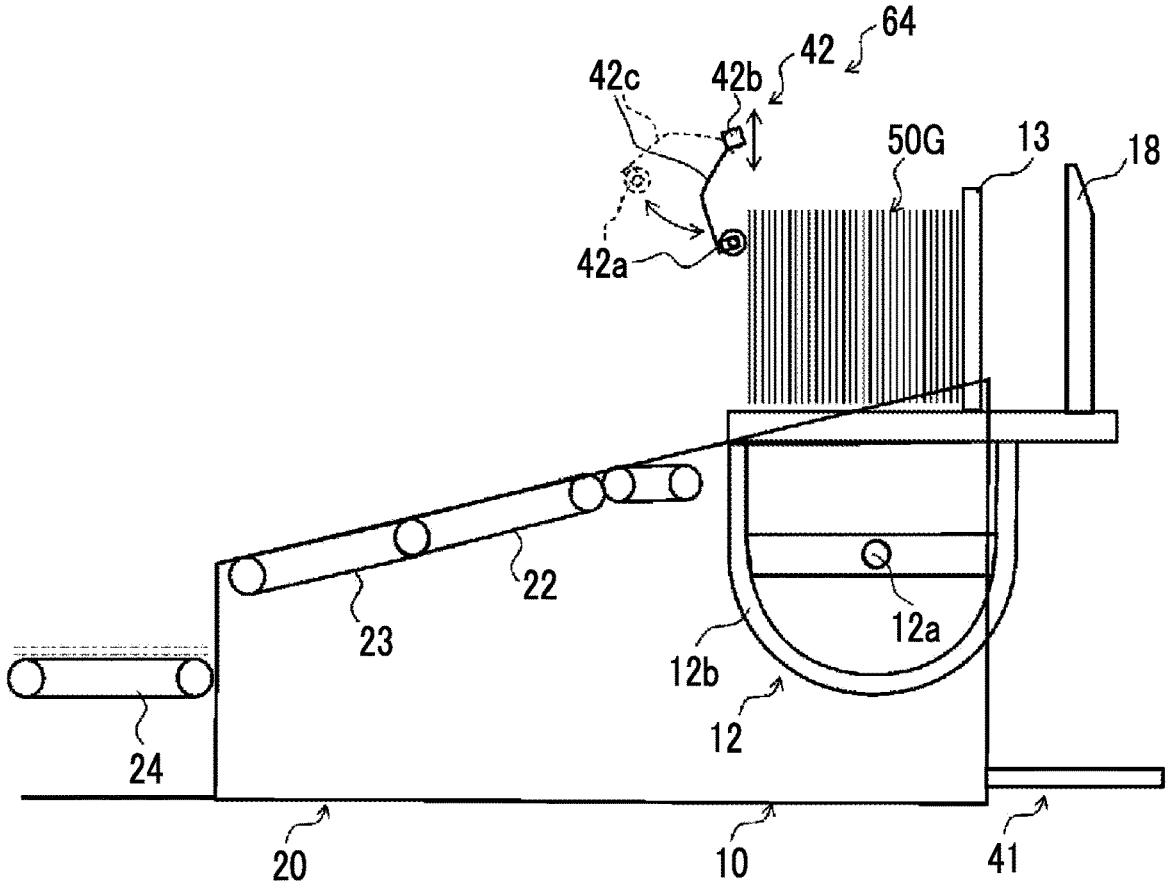
FIGS. 11A and 11B are views illustrating an overall configuration of a sheet supply device according to a fourth embodiment.
Figure 11B:
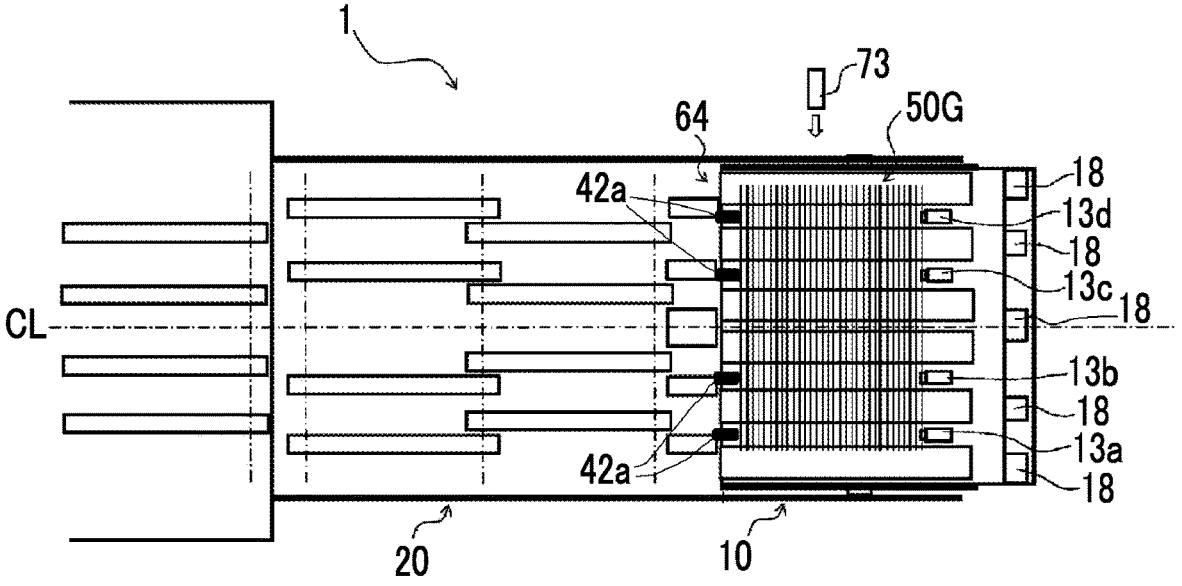

As shown in FIGS. 11A and 11B, when the device related to the centering according to the present embodiment is at a position where the sheet group 50G is lifted and inverted (the posture of the sheet group 50G is a state close to the forwardly inclined posture or the forwardly inclined posture), a gripping type movement mechanism 64 is included that grips the sheet group 50G to move the sheet group 50G in the width direction, and the gripping type movement mechanism 64 is applied to the width-direction movement mechanism 60.

In particular, in the present embodiment, the gripping type movement mechanism 64 includes the arm portions 13*a* to 13*d* of the fork portion 13, the rollers 42*a* of the above transfer sheet support 42, and an actuator (not shown) that moves the arm portions 13*a* to 13*d* of the fork portion 13 and the rollers 42*a* of the transfer sheet support 42 in the width direction in synchronization with each other. In addition, in FIGS. 11B, 12A, and 12B, the description of the rollers 41*a* of the dispensing device 41 is omitted.

The gripping type movement mechanism 64 may be a mechanism that moves at least the arm portions 13*a* to 13*d* of the fork portion 13 and the rollers 42*a* of the transfer sheet support 42 in the width direction in synchronization with each other by the actuator (not shown). For example, in order to move the arm portions 13*a* to 13*d*, as in the second embodiment, it is also preferable that the fork portion 13 includes the support 130 and the fork portion body 131 that is movable in the width direction with respect to the support 130, and the arm portions 13*a* to 13*d* equipped on the fork portion body 131 are integrally moved in the width direction. Similarly, in order to move the plurality of rollers 42*a*, it is also preferable that a support member that supports the plurality of rollers 42*a* is made movable in the width direction and the support member is moved in the width direction to move the plurality of rollers 42*a* integrally in the width direction.

In such a gripping type movement mechanism 64, when the lift portion 10 approaches the inversion completion state, the moving sheet support 42 is made to abut against the tip side of the sheet group 50G supported by the fork portion 13 on the rear end side, and the fork portion 13 and the moving sheet support 42 are made to cooperate with each other to grip the sheet group 50G so as to be sandwiched from both sides in the flat stacking direction. However, by increasing this gripping force, the sheet group 50G can be gripped from both sides in the flat stacking direction and can be moved in the width direction.

Figure 12A:
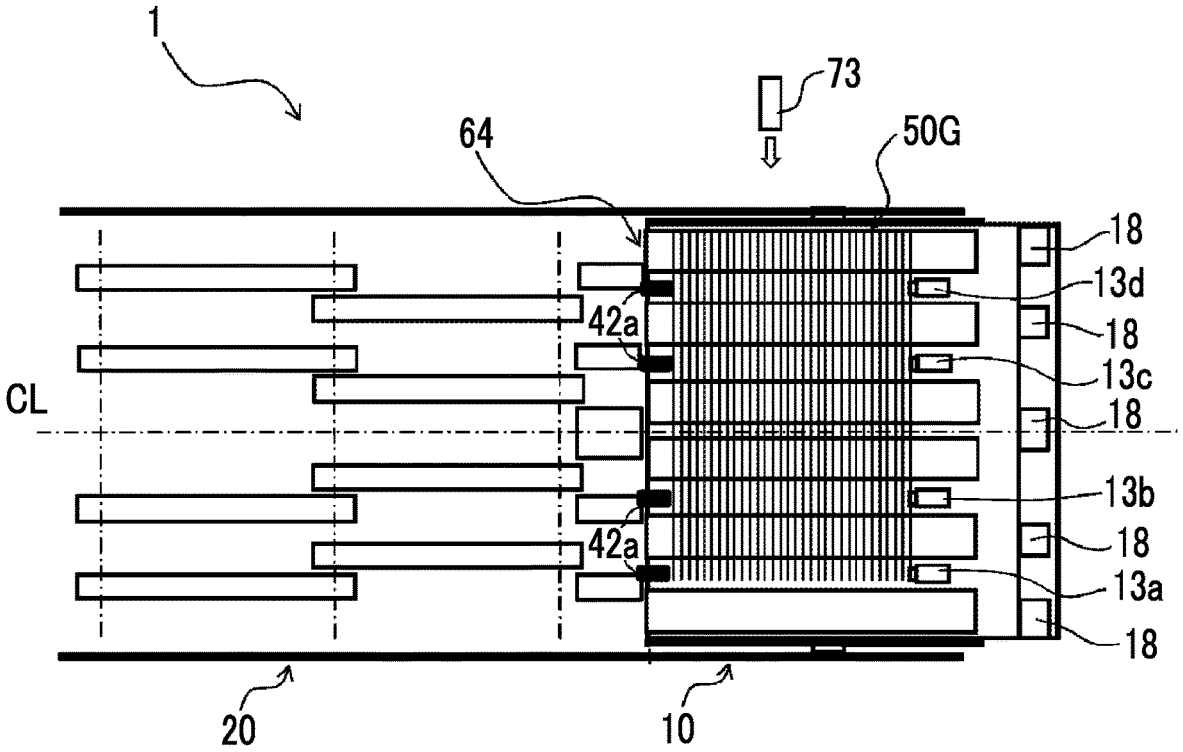
FIGS. 12A and 12B are schematic plan views of principal portions of the sheet supply device illustrating a configuration of a width-direction movement mechanism of the sheet supply device according to the fourth embodiment.
Figure 12B:
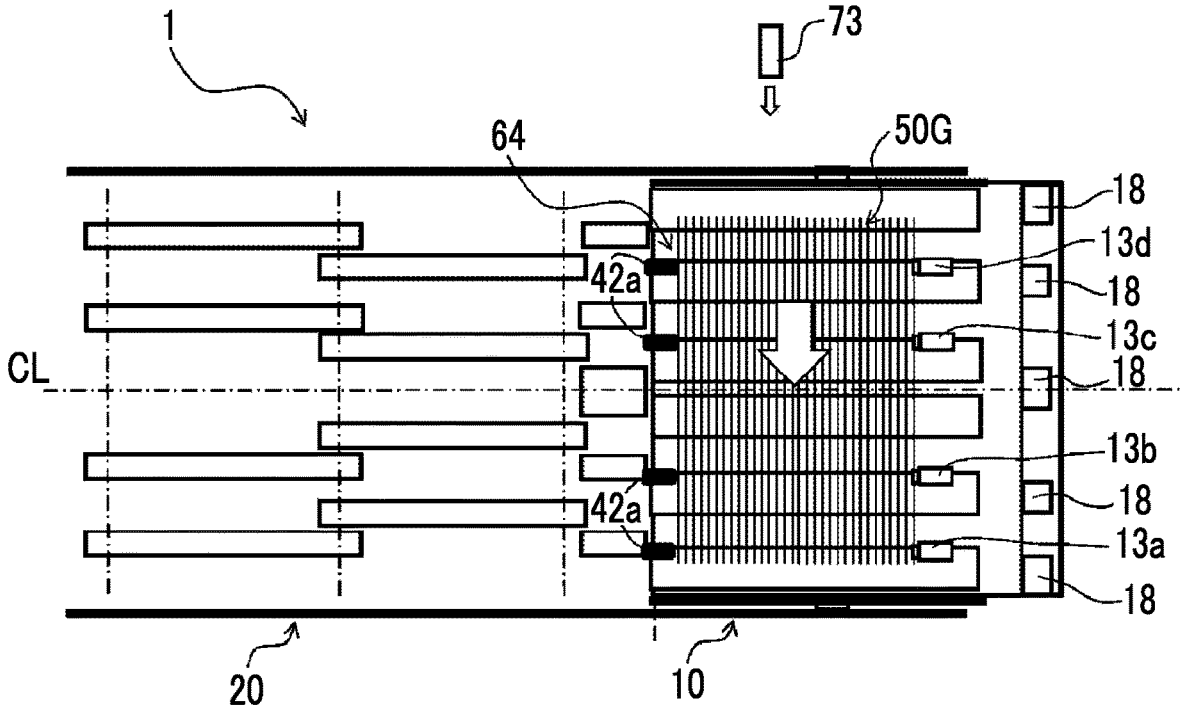

As shown in FIG. 5, the device related to centering according to the present embodiment includes the gripping type movement mechanism 64 as the width-direction movement mechanism, a gripping position sensor 73 as the position sensor, and the centering control device 80. Similar to the first to third embodiments, the centering control device 80 controls the gripping type movement mechanism 64, that is, the fork portion 13 and the moving sheet support 42 on the basis of the detection information of the gripping position sensor 73, and as shown in FIGS. 12A and 12B, operates the gripping type movement mechanism 64 to center the width-direction position of the sheet group 50G within the reference width-direction range.

Additionally, in the gripping type movement mechanism 64 as the width-direction movement mechanism 60, the arm portions 13*a* to 13*d* of the fork portion 13 and the rollers 42*a* of the transfer sheet support 42 is a moving body that moves in the width direction to move the sheet group 50G in the width direction. Also in the present embodiment, after the transfer of the sheet group 50G to the conveyor portion 20 is completed, the transfer control device 31 performs the initial position return control of returning the fork portion 10 to the initial position, but the centering control device 80 performs the neutral position return control of returning the arm portions 13*a* to 13*d* of the fork portion 13 and the roller 42*a* of the transfer sheet support 42 as the moving body to the neutral position in the width direction.

According to the present embodiment, in the lift portion 10, the existing moving sheet support 42 is utilized to suppress an increase in the longitudinal size of the entire device to secure the degree of freedom in the factory layout, and to suppress an increase in cost while performing the centering of the sheet group 50G.

Additionally, after the transfer of the sheet group 50G to the conveyor portion 20 is completed, the neutral position return control of returning the arm portions 13*a* to 13*d* of the fork portion 13 and the rollers 42*a* of the transfer sheet support 42 to the neutral position in the width direction is performed during the initial position return control of returning the fork portion 10 to the initial position. Thus, the centering of the next sheet group 50G can be performed without any trouble.

Others

Although the embodiments have been described above, the width-direction movement mechanisms are not limited to the above embodiments, and for example, a side jogger may be equipped on the lift portion and adopted for the width-direction movement mechanism.

The width-direction movement mechanism according to the present case only needs to be able to move the sheet group 50G in the width direction, and unlike the side jogger, it is not required to align the end edges of the sheets 50 in the width direction. However, by applying the side jogger, the centering of the sheet group 50G can be performed while aligning the end edges of the respective sheets 50 in the width direction, and the processing of the respective sheets on the downstream side can be more appropriately and easily performed.

Additionally, in the respective embodiments, the reference width-direction range is set within a range of ±50 mm with respect to the width-direction reference position (the width-direction center CL of the device) However, an allowable width with respect to the width-direction reference position is not limited to the range of ±50 mm and can be set appropriately.

REFERENCE SIGNS LIST

1 Sheet supply device
10 Lift portion
11 Fixed frame
11A Movable base frame
12 Movable frame
12A to 12F Pillar
12*a* Rotating shaft
12*b* Arch portion
12*c* Girder portion
13 Fork portion
13*a* to 13*d* Arm portion
13A Mounting surface
14 Inversion mechanism
15 Fork movement mechanism
16F Support surface
17 Suction portion
18 Lift conveyor
18A Conveyor
20 Conveyor portion
21 First conveyor

22 Second conveyor
23 Third conveyor
24 Hopper
31 Transfer control device
41 Dispensing device
41*a* Roller
42 Moving sheet support
42*a* Roller
42*b* Support
42*c* Arm
50 Sheet
50G Plurality of sheets (sheet group)
51 Lowermost sheet
60 Width-direction movement mechanism
61 Roller conveyor device as width-direction movement mechanism
62 Fork portion movement mechanism as width-direction movement mechanism
63 Frame movement mechanism as width-direction movement mechanism
64 Gripping type movement mechanism as width-direction movement mechanism
70 Position sensor
71 Initial position sensor as position sensor
72 Inversion completion position sensor as position sensor
73 Gripping position sensor as position sensor
80 Centering control device
130 Support
131 Fork portion body
CL Width-direction center of device

The invention claimed is:

1. A sheet supply device comprising:
a lift portion that lifts and inverts a sheet group including a plurality of flatly stacked sheets;
a conveyor portion that moves each sheet of the sheet group transferred from the lift portion in a transport direction;
wherein the lift portion is configured to include a frame that extends in a flat stacking direction of the sheet group, a fork portion that is supported by the frame so as to be movable in the flat stacking direction and has the sheet group mounted thereon, an inversion mechanism that turns the fork portion to lift and invert the mounted sheet group, and a fork movement mechanism that moves the fork portion in the flat stacking direction,
a width-direction movement mechanism that is equipped on the lift portion and moves the mounted sheet group in a width direction;
a position sensor that detects a width-direction position of the sheet group; and
a centering control device that controls the width-direction movement mechanism on the basis of detection information of the position sensor, and centers the width-direction position of the sheet group within a reference width-direction range, from when the sheet group is mounted on the fork portion to when the sheet group is transferred to the conveyor portion.

2. The sheet supply device according to claim 1,
wherein the width-direction movement mechanism is a roller conveyor device including a roller that is disposed below the lowered fork portion at an initial position and is lifted and moved vertically upward from the fork portion at the initial position to support the sheet group to move the sheet group in the width direction.

3. The sheet supply device according to claim 2,
wherein a dispensing device that moves a lowermost layer sheet of the sheet group in the width direction and dispenses the lowermost layer sheet to a lateral side of the dispensing device is applied to the roller conveyor device.

4. The sheet supply device according to claim 2,
wherein when the fork portion is at the initial position, the centering control device controls the roller conveyor device on the basis of the detection information of the position sensor and centers the width-direction position of the sheet group within the reference width-direction range.

5. The sheet supply device according to claim 2,
wherein when the fork portion is lifted from the initial position, the centering control device controls the roller conveyor device on the basis of the detection information of the position sensor and centers the width-direction position of the sheet group within the reference width-direction range.

6. The sheet supply device according to claim 1,
wherein the fork portion includes
a fork portion body on which the sheet group is mounted,
a support that movably supports the fork portion body in the width direction, and
a fork portion movement mechanism that moves the fork portion body in the width direction with respect to the support to move the mounted sheet group in the width direction, and
the width-direction movement mechanism is the fork portion movement mechanism.

7. The sheet supply device according to claim 6,
wherein the centering control device controls the fork portion movement mechanism on the basis of the detection information of the position sensor while the fork portion is lifted or inverted, and centers the width-direction position of the sheet group within the reference width-direction range.

8. The sheet supply device according to claim 1,
wherein the width-direction movement mechanism is a frame movement mechanism that moves the frame in the width direction to move the mounted sheet group in the width direction.

9. The sheet supply device according to claim 8, further comprising:
two rails that extend in the width direction; and
a movable base frame that is equipped on the two rails so as to be movable in the width direction and forms a part of the frame,
wherein the frame movement mechanism moves the movable base frame in the width direction to move the mounted sheet group in the width direction.

10. The sheet supply device according to claim 1, further comprising:
a gripping type movement mechanism that grips the sheet group to move the sheet group in the width direction when the sheet group is at a lifted and inverted position,
wherein the gripping type movement mechanism is applied to the width-direction movement mechanism.

11. The sheet supply device according to claim 10, further comprising:
a transfer sheet support that is provided so as to face the fork portion when the sheet group is at a lifted and inverted position, and grips the sheet group from both end sides in the flat stacking direction in cooperation with the fork portion to guide the transfer of the sheet group to the conveyor portion, wherein the gripping type movement mechanism includes the fork portion and the transfer sheet support.

12. The sheet supply device according to claim 1, wherein the lift portion includes a transfer control device that controls the inversion mechanism and the fork movement mechanism, the width-direction movement mechanism includes a moving body that moves in the width direction to move the sheet group in the width direction, the transfer control device performs initial position return control of returning the fork portion to the initial position after the transfer of the sheet group to the conveyor portion is completed, and the centering control device performs neutral position return control of returning the moving body to a neutral position in the width direction during the initial position return control.

13. The sheet supply device according to claim 1, wherein the reference width-direction range is within a range of ±50 mm with respect to a width-direction reference position.

* * * * *